US011597211B2

(12) United States Patent
Chick et al.

(10) Patent No.: US 11,597,211 B2
(45) Date of Patent: Mar. 7, 2023

(54) PRINT MATERIAL VISUAL INDICATOR

(71) Applicant: Hewlett-Packard Development Company, L.P., Spring, TX (US)

(72) Inventors: Andrew Chick, Vancouver, WA (US); Pratik Shah, San Diego, CA (US); Kenneth K Smith, Boise, ID (US); Adam L Hornstein, San Diego, CA (US); Dustin C Rosing, San Diego, CA (US); Richard Motzkus, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/274,267

(22) PCT Filed: Oct. 8, 2018

(86) PCT No.: PCT/US2018/054835
§ 371 (c)(1),
(2) Date: Mar. 8, 2021

(87) PCT Pub. No.: WO2020/076283
PCT Pub. Date: Apr. 16, 2020

(65) Prior Publication Data

US 2021/0316555 A1 Oct. 14, 2021

(51) Int. Cl.
*B41J 2/175* (2006.01)

(52) U.S. Cl.
CPC ..... *B41J 2/17566* (2013.01); *B41J 2/17506* (2013.01); *B41J 2002/17573* (2013.01)

(58) Field of Classification Search
CPC ..... B41J 2/17566; B41J 2/17506; B41J 2/17546; B41J 2002/17573; G03G 15/556
See application file for complete search history.

(56) References Cited

U.S. PATENT DOCUMENTS

| | | | | |
|---|---|---|---|---|
| 5,802,420 | A | 9/1998 | Garr et al. | |
| 7,801,453 | B2 | 9/2010 | Golding et al. | |
| 8,121,901 | B2 | 2/2012 | Blanchard, Jr. et al. | |
| 8,199,353 | B2 | 6/2012 | Kuwasaki | |
| 9,298,156 | B2 | 3/2016 | Fukuoka et al. | |
| 2008/0055378 | A1 | 3/2008 | Drury et al. | |
| 2009/0185814 | A1 | 7/2009 | Willis | |
| 2010/0295562 | A1 | 11/2010 | Fuetterer et al. | |
| 2011/0057971 | A1* | 3/2011 | Yokoyama | B41J 2/17509 347/7 |
| 2011/0311242 | A1 | 12/2011 | Tanda | |
| 2016/0200115 | A1* | 7/2016 | Niiyama | B41J 2/17566 347/7 |

(Continued)

FOREIGN PATENT DOCUMENTS

| | | | |
|---|---|---|---|
| CN | 101395005 | A | 3/2009 |
| CN | 101685280 | A | 3/2010 |

(Continued)

*Primary Examiner* — Sharon Polk
(74) *Attorney, Agent, or Firm* — Brooks, Cameron & Huebsch, PLLC

(57) ABSTRACT

Examples disclosed herein relate to identifying an amount of remaining supply of a print material, selecting one of a plurality of threshold ranges associated with the amount of remaining print material, and updating a visual indicator indicative of the selected one of the plurality of threshold ranges.

18 Claims, 4 Drawing Sheets

(56) References Cited

U.S. PATENT DOCUMENTS

| | | | | |
|---|---|---|---|---|
| 2017/0157943 | A1* | 6/2017 | Koganehira | ..... B41J 2/17566 |
| 2018/0370241 | A1* | 12/2018 | Koganehira | ..... B41J 2/175 |

FOREIGN PATENT DOCUMENTS

| | | | | | |
|---|---|---|---|---|---|
| CN | 102896918 | A | | 1/2013 | |
| CN | 103373059 | A | | 10/2013 | |
| CN | 105699905 | A | | 6/2016 | |
| CN | 107097529 | A | * | 8/2017 | ..... B41J 2/17506 |
| EP | 0 878 745 | A2 | | 11/1998 | |
| JP | S58-211456 | A | | 12/1983 | |
| JP | 4051894 | B2 | * | 2/2008 | ..... B41J 2/17509 |
| JP | 4077953 | B2 | * | 4/2008 | ..... B41J 2/17546 |
| JP | 2008-155649 | A | | 7/2008 | |
| JP | 2013-29980 | A | | 2/2013 | |
| WO | WO-2020196731 | A1 | * | 10/2020 | ..... B41J 2/1752 |

* cited by examiner

100

PRINT MATERIAL VISUAL INDICATOR

BACKGROUND

Multi-function devices often combine different components such as a printer, scanner, and copier into a single device. Such devices may be configured to receive refills of consumables, such as print materials (e.g., ink, toner, and/or additive materials) and/or media (e.g., paper, vinyl, and/or other print substrates).

Figure 1A:
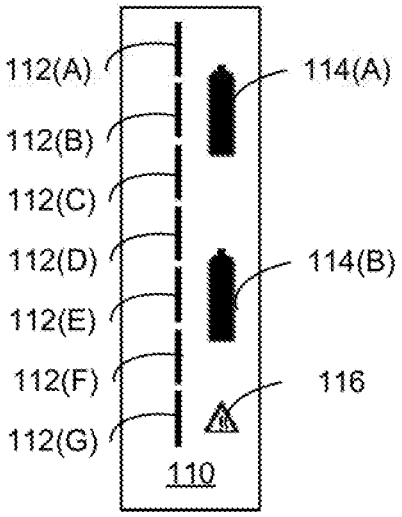
FIGS. 1A-1D are diagrams of example implementations of print material visual indicators.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

Printing devices can include a supply of print materials including print material particles located in a container (e.g., a hopper, a reservoir, etc.). As used herein, the term "print materials" refers to a substance which, when applied to a medium, can form representation(s) on the medium during a print job. For example, print materials can include a toner material, liquid-based print materials such as ink, or other powder and/or particulate such as additive materials. In some examples, the print material particles can be deposited in successive layers to create three-dimensional (3D) objects. For example, print material particles can include a toner material, a powdered semi-crystalline thermoplastic material, a powdered metal material, a powdered plastic material, a powdered composite material, a powdered ceramic material, a powdered glass material, a powdered resin material, and/or a powdered polymer material, among other types of powdered or particulate material. The print material particles can be particles with an average diameter of less than one hundred microns. For example, the print material particles can be particles with an average diameter of between 0-100 microns. However, examples of the disclosure are not so limited. For example, print material particles can be particles with an average diameter of between 20-50 microns, 5-10 microns, or any other range between 0-100 microns. The print material particles can be fused when deposited to create 3D objects.

The print materials can be deposited onto a physical medium. As used herein, the term "printing device" refers to any hardware device with functionalities to physically produce representation(s) on the medium. In some examples, the printing device can be a laser printer, a scanning device, or a laser printer/scanner combination device, among others.

The container including the print materials may be inside of the printing device and include a supply of the print materials such that the printing device may draw the print materials from the container as the printing device creates the images on the print medium. As used herein, the term "container" refers to a reservoir, a hopper, a tank, and/or a similar vessel to store a supply of the print materials for use by the printing device.

As the printing device draws the print materials from the container, the amount of print materials in the container may deplete. In traditional devices, the print materials are often in a self-contained, replaceable component. These components may be swapped out by a user after they are depleted. This sometimes results in wasted print material when the components are replaced too early.

In some examples illustrated herein, the amount of print materials in the container of the printing device may be replenished in-situ via a material container, such as a bag, syringe, bottle and/or other container. A replenishment device may be utilized to fill and/or refill the container of the printing device with print materials. During a fill and/or refill operation, the replenishment can transfer print materials from the print materials supply to the container of the printing device. For instance, the print materials container can be coupled to an access port of a cartridge device that can receive a replenishment device. The replenishment device can replenish the print materials container in-situ such that the cartridge device, including the print materials container, remain within a printing device during replenishment. For instance, some examples of the present disclosure allow for replenishment of print materials in a manner that may be more convenient, faster, and simpler for a user as compared to other approaches.

The printing device may comprise a visual indicator to indicate how much of the print material remains available and/or when refill of the print material is appropriate. For example, a "fuel gauge" type display may decrease as the print material is consumed. For another example, an icon associated with the print material, such as a material container, may illuminate when the print material is at a suitable level for refilling. Such an indicator may serve the dual purpose of ensuring the user does not run out of printing material and ensuring that the user does not refill the printing material too early with the risk of overfilling and/or overflowing.

FIG. 1A is an example diagram of a first implementation 110 of a print material visual indicator. Implementation 110 may comprise a plurality of segments 112(A)-(G) akin to a fuel gauge. As print material is consumed, segments 112(A)-(G) may be displayed in such a way to indicate depletion, such as by illuminating all of segments 112(A)-(G) when the print material level is full and illuminating segments 112(C)-112(G) when the print material level is ⅔ full. Implementation 110 may further comprise a plurality of icons 114(A)-(B) associated with the print material, such as icons in the shape of a refill bottle. Once the print material drops to and/or below a threshold level, such as ⅔ and/or ½ full, icon 114(A) may illuminate to indicate that refill of the print material is now available and/or recommended. When the print material drops to and/or below a second threshold level, such as below ½ or ⅓ full, second icon 114(B) may illuminate in addition to and/or instead of first icon 114(A) to indicate that supplies of the print material should be replenished soon.

First implementation 110 may further comprise a status icon 116 to indicate various conditions, such as a problem with the print material and/or a need to replenish the print material. For example, if the remaining print material reaches a threshold associated with recommending refill, status icon 116 may illuminate in a first color, such as yellow and/or amber. Such a threshold may be the same and/or different than the threshold for illuminating first icon 114(A) and/or second icon 114(B).

In various implementation, different color and/or illumination schemes may be used. For example, segments 112 (A)-(G) may illuminate from top to bottom and/or from bottom to top as print material is consumed. The illumination of segments 112(A)-(G) may comprise different colors, such as changing from white to yellow to red as thresholds of remaining print material are reached.

Figure 1B:
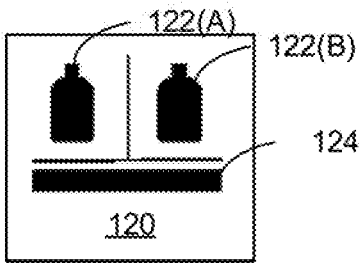
Figure 1C:
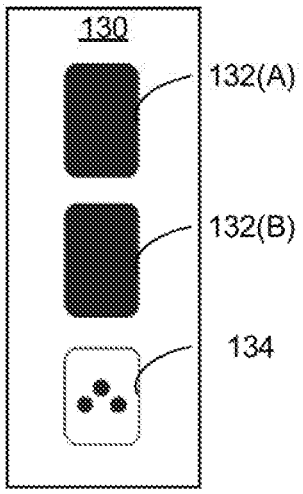

FIG. 1B is an example diagram of a second implementation 120 of a print material visual indicator. Second implementation 120 may comprise a plurality of icons 122(A)-(B) associated with the print material and a status icon 124. Icons 122(A)-(B) and status icon 124 may operate similar to the similarly named components described above with respect to FIG. 1A.

FIG. IC is an example diagram of a third implementation 130 of a print material visual indicator. Third implementation 130 may comprise a plurality of icons 132(A)-(B) associated with the print material and a status icon 134. Icons 132(A)-(B) and status icon 134 may operate similar to the similarly named components described above with respect to FIG. 1A.

Figure 1D:
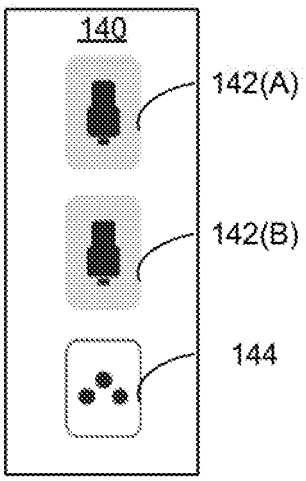

FIG. 1D is an example diagram of a fourth implementation 140 of a print material visual indicator. Fourth implementation 140 may comprise a plurality of icons 142(A)-(B) associated with the print material and a status icon 144. Icons 142(A)-(B) and status icon 144 may operate similar to the similarly named components described above with respect to FIG. 1A.

In various examples, implementations 110, 120, 130, 140 may comprise a dedicated, illumination-enabled display on a print device, such as a set of LED lights, an LCD and/or other display screen, a light-guide based display, a segment display, etc. In some implementations, implementations 110, 120, 130, 140 may be displayed on a multi-purpose display, such as a printer control panel and/or application user interface.

Figure 2:
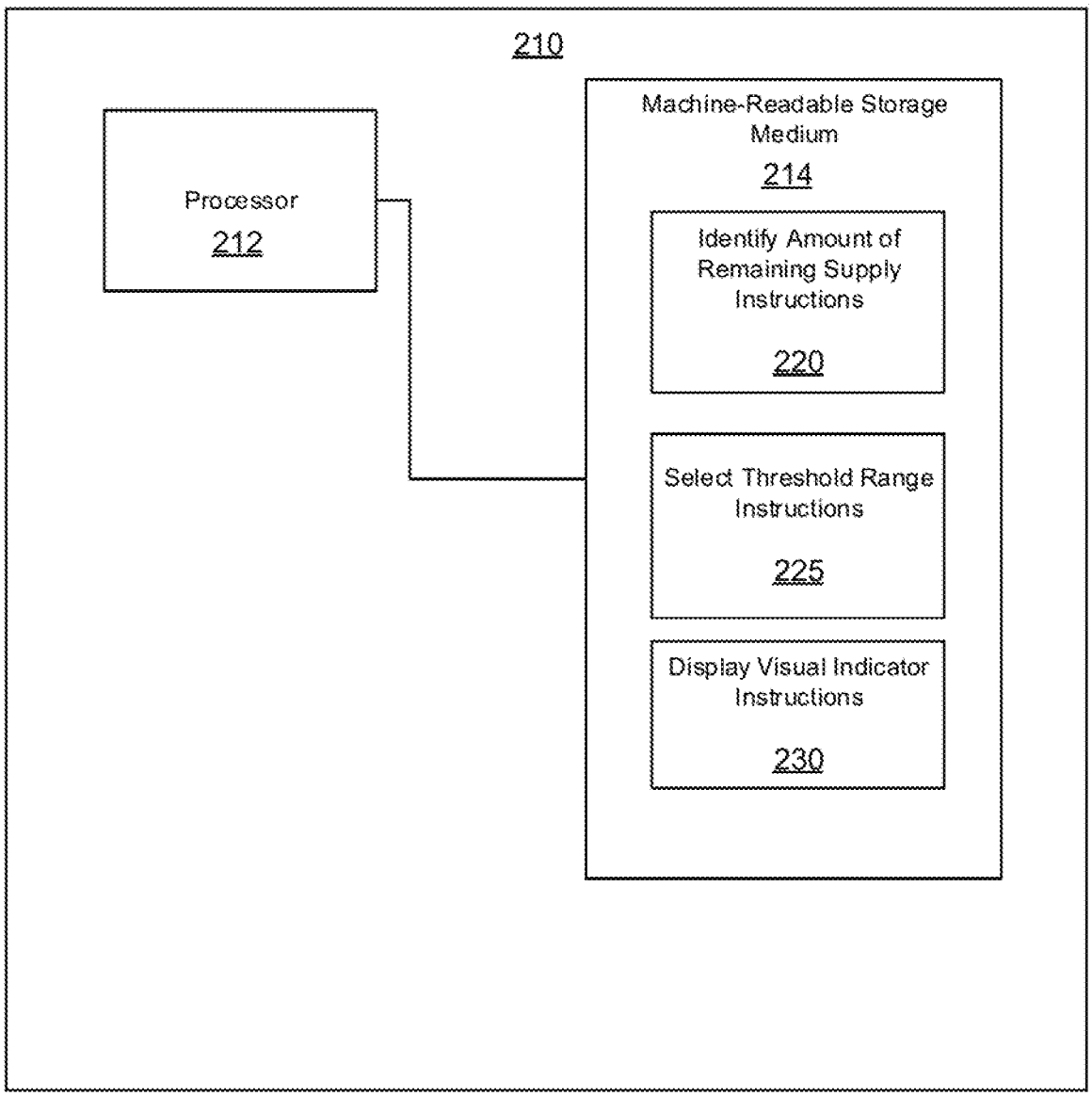
FIG. 2 is a block diagram of n example computing device for providing a print material visual indicator.

FIG. 2 is a block diagram of an example computing device 210 for providing a print material visual indicator. Computing device 210 may comprise a processor 212 and a non-transitory, machine-readable storage medium 214. Storage medium 214 may comprise a plurality of processor-executable instructions, such as identify amount of remaining supply instructions 220, select threshold range instructions 225, and display visual indicator instructions 230. In some implementations, instructions 220, 225, 230 may be associated with a single computing device 210 and/or may be communicatively coupled among different computing devices such as via a direct connection, bus, or network.

Processor 212 may comprise a central processing unit (CPU), a semiconductor-based microprocessor, a programmable component such as a complex programmable logic device (CPLD) and/or field-programmable gate array (FPGA), or any other hardware device suitable for retrieval and execution of instructions stored in machine-readable storage medium 214. In particular, processor 212 may fetch, decode, and execute instructions 220, 225, 230.

Executable instructions 220, 225, no may comprise logic stored in any portion and/or component of machine-readable storage medium 214 and executable by processor 212, The machine-readable storage medium 214 may comprise both volatile and/or nonvolatile memory and data storage components. Volatile components are those that do not retain data values upon loss of power. Nonvolatile components are those that retain data upon a loss of power.

The machine-readable storage medium 214 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, and/or a combination of any two and/or more of these memory components. In addition, the RAM may comprise, for example, static random access memory (SRAM), dynamic random access memory (DRAM), and/or magnetic random access memory (MRAM) and other such devices. The ROM may comprise, for example, a programmable read-only memory (PROM), an erasable programmable read-only memory (EPROM), an electrically erasable programmable read-only memory (EEPROM), and/or other like memory device.

Identify amount of remaining supply instructions 220 may identify an amount of remaining supply of a print material. For example, an amount of print material may be measured according to weight and/or volume. Such amounts may be tracked as the print material is consumed and/or refill print material is added to identify remaining amounts. Such print materials may comprise, for example, ink, toner particles, additive materials for 3D printing, and/or media. In some implementations, the amount of print material remaining may be measured in terms of remaining printable pages. Such a measurement may be made according to the amount of print material to create an average page, such as a page with 5% coverage. In some implementations, the measurement may be made according to other algorithms, such as the International Standards Organization (ISO) 19752 standard on a method for the determination of toner cartridge yield for monochromatic electrophotographic printers and multi-function devices that contain printer components.

Select threshold range instructions 225 may select one of a plurality of threshold ranges associated with the amount of remaining print supply. In some implementations, a first threshold range of the plurality of threshold ranges may comprise a maximum level of the amount of the remaining supply of the print material at which a refill of the print material may be performed, a second threshold range of the plurality of threshold ranges may comprise a range of the amounts of the remaining supply of the print material at which a refill of the print material should be performed, and/or a third threshold range of the plurality of threshold ranges may comprise a minimum level of the amount of the remaining supply of the print material at which a refill of the print material must be performed. For example, a full reservoir of print material may comprise the first threshold and may be measured as greater than 10,000 pages. The second threshold may comprise a measurement between 1,000 and 5,000 pages of print material remaining, and the third threshold may comprise a measurement of less than 500 pages of print material remaining.

The thresholds used in various implementations may depend on which visual indicator style is being used. For example, first implementation 110 of the visual indicator comprises six segments 112(A)-(G) that may be used to represent six threshold ranges. If differing colors are used for each segment, additional threshold ranges may be represented. For example, the six segments 112(A)-(G) may be all lit in a first color, such as white, when the maximum threshold of print material is selected. For this example, a maximum threshold may comprise sufficient print material to produce more than 12,000 pages. When the identified amount of remaining print material results in a selection of a second threshold, such as between 10,000 and 11,000 pages remaining, the first segment 112(A) may be changed to yellow. When the identified amount of remaining print material results in a selection of a third threshold, such as between 9,000 and 10,000 pages remaining, the first segment 112(A) may become non-illuminated while segments 112(B)-(G) remain illuminated in white. This progress may be continued for each segment until a last threshold, indicating that the print material has been depleted, may result in all six segments 112(A)-(G) being non-illuminated and/or illuminated in red.

In another example, such as with second implementation 120 of the visual indicator, icons 122(A)-(B) may be non-illuminated when the first threshold is selected, icon 122(A) may become illuminated to indicate refill is possible when the second threshold is selected, and both icons 122(A)-(B) may be illuminated when a third threshold is selected.

Display visual indicator instructions 230 may display, according to the selected one of the plurality of threshold ranges, a visual indicator comprising an icon associated with the print material indicative of the selected one of the plurality of threshold ranges. For example, when a threshold range indicating that enough space is free in a print material reservoir for a refill, an icon such as 114(A), 122(A), 132(A), and/or 142(A) may be illuminated to indicate to a user that a print material container may be used to replenish the print material.

In some implementations, the icon may comprise a representation of a print material container for the print material. For example, in first implementation 110 and second implementation 120, icons 114(A)-(B) and 122(A)-(B), respectively, represent the shape of bottles containing refill print materials.

In some implementations, the visual indicator may comprise a plurality of the icon associated with the print material and/or a color for each of the plurality of the icon associated with the print material. For example, implementations 110, 120, 130, and 140 of the visual indicator each provide for multiple icons to be used to represent a current threshold range of the remaining supply of the print material (e.g., 112(A)-(G), 122(A)-(B), 132(A)-(B), and 142(A)-(B), respectively).

The visual indicator may, in some implementations, vary the color for each of the plurality of the icon associated with the print material and/or the number of the plurality of the icon associated with the print material. For example, the second threshold range of the plurality of threshold ranges may be associated with the visual indicator being displayed in a yellow/amber color and/or as a single icon and the third threshold range of the plurality of threshold ranges may be associated with visual indicator being displayed in a red color and/or two or more icons.

Figure 3:
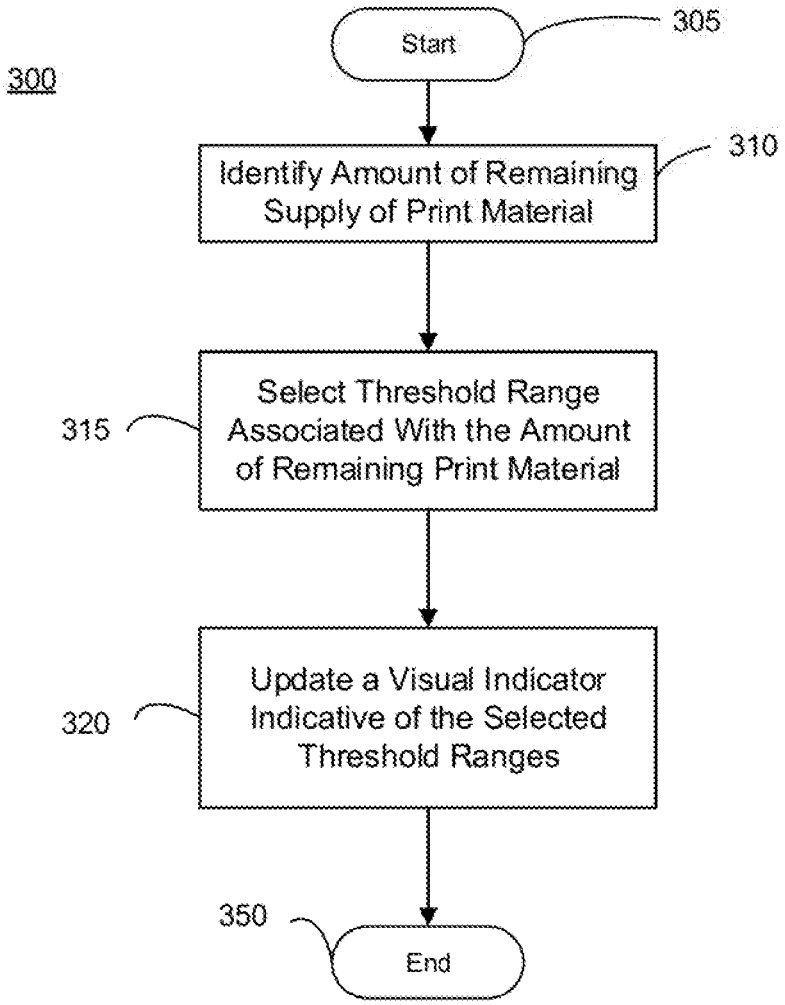
FIG. 3 is a flowchart of an example method for providing a print material visual indicator.

FIG. 3 is a flowchart of an example method 300 for print material visual indicator. Although execution of method 300 is described below with reference to computing device 210, other suitable components for execution of method 300 may be used.

Method 300 may begin at stage 305 and advance to stage 310 where device 210 may identify an amount of remaining supply of a print material. In some implementations, the amount of remaining supply may comprise a number of printable pages. For example, the amount of remaining supply may be calculated against the amount of print material needed to produce pages comprising an average 5% coverage of print material.

For example, device 210 may execute identify amount of remaining supply instructions 220 may identify an amount of remaining supply of a print material. For example, an amount of print material may be measured according to weight and/or volume. Such amounts may be tracked as the print material is consumed and/or refill print material is added to identify remaining amounts. Such print materials may comprise, for example, ink, toner particles, additive materials for 3D printing, and/or media. In some implementations, the amount of print material remaining may be measured in terms of remaining printable pages. Such a measurement may be made according to the amount of print material to create an average page, such as a page with 5% coverage. In some implementations, the measurement may be made according to other algorithms, such as the International Standards Organization (ISO) 19752 standard on a method for the determination of toner cartridge yield for monochromatic electrophotographic printers and multifunction devices that contain printer components.

Method 300 may then advance to stage 315 where computing device 210 may select one of a plurality of threshold ranges associated with the amount of remaining print material. For example, device 210 may execute select threshold range instructions 225 may select one of a plurality of threshold ranges associated with the amount of remaining print supply. In some implementations, a first threshold range of the plurality of threshold ranges may comprise a maximum level of the amount of the remaining supply of the print material at which a refill of the print material may be performed, a second threshold range of the plurality of threshold ranges may comprise a range of the amounts of the remaining supply of the print material at which a refill of the print material should be performed, and/or a third threshold range of the plurality of threshold ranges may comprise a minimum level of the amount of the remaining supply of the print material at which a refill of the print material must be performed. For example, a full reservoir of print material may comprise the first threshold and may be measured as greater than 10,000 pages. The second threshold may comprise a measurement between 1,000 and 5,000 pages of print material remaining, and the third threshold may comprise a measurement of less than 500 pages of print material remaining.

The thresholds used in various implementations may depend on which visual indicator style is being used. For example, first implementation 110 of the visual indicator comprises six segments 112(A)-(G) that may be used to represent six threshold ranges. If differing colors are used for each segment, additional threshold ranges may be represented. For example, the six segments 112(A)-(G) may be all lit in a first color, such as white, when the maximum threshold of print material is selected. For this example, a maximum threshold may comprise sufficient print material to produce more than 12,000 pages. When the identified amount of remaining print material results in a selection of a second threshold, such as between 10,000 and 11,000 pages remaining, the first segment 112(A) may be changed to yellow. When the identified amount of remaining print material results in a selection of a third threshold, such as between 9,000 and 10,000 pages remaining, the first segment 112(A) may become non-illuminated while segments 112(B)-(G) remain illuminated in white. This progress may be continued for each segment until a last threshold, indicating that the print material has been depleted, may result in all six segments 112(A)-(G) being non-illuminated and/or illuminated in red.

In another example, such as with second implementation 120 of the visual indicator, icons 122(A)-(B) may be non-illuminated when the first threshold is selected, icon 122(A) may become illuminated to indicate refill is possible when the second threshold is selected, and both icons 122(A)-(B) may be illuminated when a third threshold is selected.

Method 300 may then advance to stage 320 where computing device 210 may update a visual indicator indicative of the selected one of the plurality of threshold ranges. In some implementations, the visual indicator may be configured to illuminate, in one of a plurality of colors, an icon associated with the print material. For example, device 210 may execute display visual indicator instructions 230 may display, according to the selected one of the plurality of threshold ranges, a visual indicator comprising an icon associated with the print material indicative of the selected one of the plurality of threshold ranges. For example, when a threshold range indicating that enough space is free in a print material reservoir for a refill, an icon such as 114(A), 122(A), 132(A), and/or 142(A) may be illuminated to indicate to a user that a print material container may be used to replenish the print material.

In some implementations, the icon may comprise a representation of a print material container for the print material. For example, in first implementation 110 and second implementation 120, icons 114(A)-(B) and 122(A)-(B), respectively, represent the shape of bottles containing refill print materials.

In some implementations, the visual indicator may comprise a plurality of the icon associated with the print material and/or a color for each of the plurality of the icon associated with the print material. For example, implementations 110, 120, 130, and 140 of the visual indicator each provide for multiple icons to be used to represent a current threshold range of the remaining supply of the print material (e.g., 112(A)-(G), 122(A)-(B), 132(A)-(B), and 142(A)-(B), respectively).

The visual indicator may, in some implementations, vary the color for each of the plurality of the icon associated with the print material and/or the number of the plurality of the icon associated with the print material. For example, the second threshold range of the plurality of threshold ranges may be associated with the visual indicator being displayed in a yellow/amber color and/or as a single icon and the third threshold range of the plurality of threshold ranges may be associated with visual indicator being displayed in a red color and/or two or more icons.

In some implementations, updating the visual indicator may comprise illuminating at least one of a plurality of the icon associated with the print material and/or turning off the illumination of the visual indicator for a first threshold range of the plurality of threshold ranges.

Method 300 may then end at stage 350.

Figure 4:
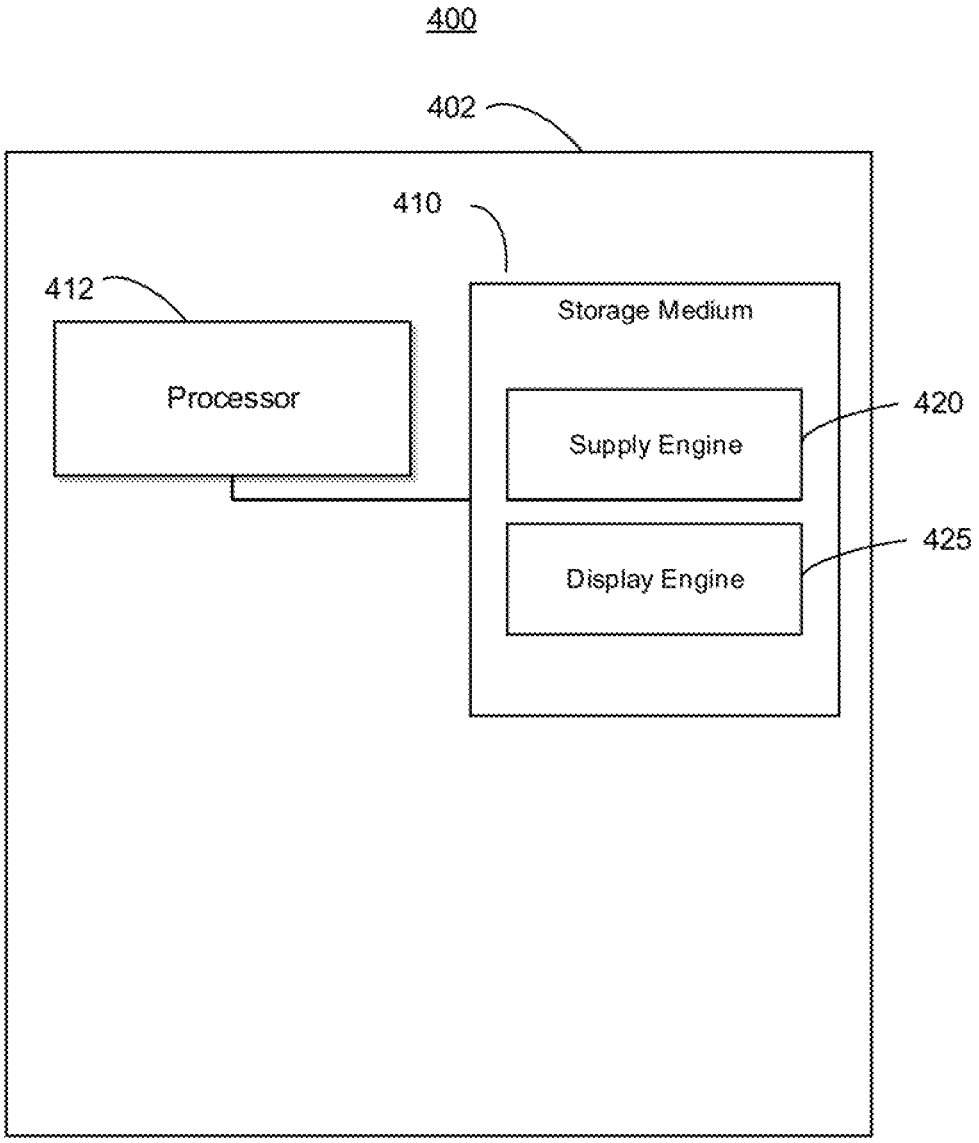
FIG. 4 is a block diagram of an example system for providing a print material visual indicator.

FIG. 4 is a block diagram of an example apparatus 400 for providing a print material visual indicator. Apparatus 400 may comprise a multi-function printer device 402 comprising a storage medium 410 and a processor 412. Device 402 may comprise and/or be associated with, for example, a general and/or special purpose computer, server, mainframe, desktop, laptop, tablet, smart phone, game console, printer, multi-function device, and/or any other system capable of providing computing capability consistent with providing the implementations described herein. Device 402 may store, in storage medium 410, a supply engine 420 and a display engine 425.

Each of engines 420, 425 may comprise any combination of hardware and programming to implement the functionalities of the respective engine. In examples described herein, such combinations of hardware and programming may be implemented in a number of different ways. For example, the programming for the engines may be processor executable instructions stored on a non-transitory machine-readable storage medium and the hardware for the engines may include a processing resource to execute those instructions. In such examples, the machine-readable storage medium may store instructions that, when executed by the processing resource, implement engines 420, 425. In such examples, device 402 may comprise the machine-readable storage medium storing the instructions and the processing resource to execute the instructions, or the machine-readable storage medium may be separate but accessible to apparatus 400 and the processing resource.

Supply engine 420 may identify an amount of remaining supply of a printing material according to a number of remaining printable pages. For example, supply engine 420 may execute select threshold range instructions 225 may select one of a plurality of threshold ranges associated with the amount of remaining print supply. In some implementations, a first threshold range of the plurality of threshold ranges may comprise a maximum level of the amount of the remaining supply of the print material at which a refill of the print material may be performed, a second threshold range of the plurality of threshold ranges may comprise a range of the amounts of the remaining supply of the print material at which a refill of the print material should be performed, and/or a third threshold range of the plurality of threshold ranges may comprise a minimum level of the amount of the remaining supply of the print material at which a refill of the print material must be performed. For example, a full reservoir of print material may comprise the first threshold and may be measured as greater than 10,000 pages. The second threshold may comprise a measurement between 1,000 and 5,000 pages of print material remaining, and the third threshold may comprise a measurement of less than 500 pages of print material remaining.

The thresholds used in various implementations may depend on which visual indicator style is being used. For example, first implementation 110 of the visual indicator comprises six segments 112(A)-(G) that may be used to represent six threshold ranges. If differing colors are used for each segment, additional threshold ranges may be represented. For example, the six segments 112(A)-(G) may be all lit in a first color, such as white, when the maximum threshold of print material is selected. For this example, a maximum threshold may comprise sufficient print material to produce more than 12,000 pages. When the identified amount of remaining print material results in a selection of a second threshold, such as between 10,000 and 11,000 pages remaining, the first segment 112(A) may be changed to yellow. When the identified amount of remaining print material results in a selection of a third threshold, such as between 9,000 and 10,000 pages remaining, the first segment 112(A) may become non-illuminated while segments 112(B)-(G) remain illuminated in white. This progress may be continued for each segment until a last threshold, indicating that the print material has been depleted, may result in all six segments 112(A)-(G) being non-illuminated and/or illuminated in red.

In another example, such as with second implementation 120 of the visual indicator, icons 122(A)-(B) may be non-illuminated when the first threshold is selected, icon 122(A) may become illuminated to indicate refill is possible when the second threshold is selected, and both icons 122(A)-(B) may be illuminated when, a third threshold is selected.

Display engine 425 may select one of a plurality of threshold ranges associated with the amount of remaining print supply and update a visual indicator indicative of the selected one of the plurality of threshold ranges, wherein the visual indicator is configured to illuminate, in one of a plurality of colors, a plurality of icons associated with the print material.

For example, display engine 425 may execute display visual indicator instructions 230 may display, according to the selected one of the plurality of threshold ranges, a visual indicator comprising an icon associated with the print material indicative of the selected one of the plurality of threshold ranges. For example, when a threshold range indicating that enough space is free in a print material reservoir for a refill, an icon such as 114(A), 122(A), 132(A), and/or 142(A) may be illuminated to indicate to a user that a print material container may be used to replenish the print material.

In some implementations, the icon may comprise a representation of a print material container for the print material. For example, in first implementation 110 and second implementation 120, icons 114(A)-(B) and 122(A)-(B), respectively, represent the shape of bottles containing refill print materials.

In some implementations, the visual indicator may comprise a plurality of the icon associated with the print material and/or a color for each of the plurality of the icon associated with the print material. For example, implementations 110, 120, 130, and 140 of the visual indicator each provide for multiple icons to be used to represent a current threshold range of the remaining supply of the print material (e.g., 112(A)-(G), 122(A)-(B), 132(A)-(B), and 142(A)-(B), respectively).

The visual indicator may, in some implementations, vary the color for each of the plurality of the icon associated with the print material and/or the number of the plurality of the icon associated with the print material. For example, the second threshold range of the plurality of threshold ranges may be associated with the visual indicator being displayed in a yellow/amber color and/or as a single icon and the third threshold range of the plurality of threshold ranges may be associated with visual indicator being displayed in a red color and/or two or more icons.

In some implementations, updating the visual indicator may comprise illuminating at least one of a plurality of the icon associated with the print material and/or turning off the illumination of the visual indicator for a first threshold range of the plurality of threshold ranges.

In the foregoing detailed description of the disclosure, reference is made to the accompanying drawings that form a part hereof, and in which is shown by way of illustration how examples of the disclosure may be practiced. These examples are described in sufficient detail to allow those of ordinary skill in the art to practice the examples of this disclosure, and it is to be understood that other examples may be utilized and that process, electrical, and/or structural changes may be made without departing from the scope of the present disclosure.

What is claimed:

1. A non-transitory machine readable medium storing instructions executable by a processor to:

identify an amount of remaining supply of a print material;

display one of a plurality of segments corresponding to the amount of remaining supply of the print material;

identify one of a plurality of threshold ranges corresponding to the amount of remaining supply of the print material; and display, according to the identified one of the plurality of threshold ranges, a visual indicator comprising an icon, wherein a first threshold range of the plurality of threshold ranges corresponds to an amount of print material to be provided by a replenishment device.

2. The non-transitory machine readable medium of claim 1, wherein the icon comprises a representation of a print material container for the print material.

3. The non-transitory machine readable medium of claim 1, wherein the visual indicator comprises a plurality of the icon associated with the print material.

4. The non-transitory machine readable medium of claim 3, wherein the visual indicator comprises a color for each of the plurality of the icon associated with the print material.

5. The non-transitory machine readable medium of claim 4, wherein the visual indicator varies the color for each of the plurality of the icon associated with the print material.

6. The non-transitory machine readable medium of claim 3, wherein the visual indicator varies the number of the plurality of the icon associated with the print material.

7. The non-transitory machine readable medium of claim 1, wherein the first threshold range of the plurality of threshold ranges further comprises a maximum level of the amount of the remaining supply of the print material at which a refill of the print material may be performed.

8. The non-transitory machine readable medium of claim 7, wherein a second threshold range of the plurality of threshold ranges comprises a range of the amounts of the remaining supply of the print material at which a refill of the print material should be performed.

9. The non-transitory machine readable medium of claim 8, wherein a third threshold range of the plurality of threshold ranges comprises a minimum level of the amount of the remaining supply of the print material at which a refill of the print material must be performed.

10. The non-transitory machine readable medium of claim 9, wherein the second threshold range of the plurality of threshold ranges is associated with the visual indicator being displayed in a yellow color and the third threshold range of the plurality of threshold ranges is associated with the visual indicator being displayed in a red color.

11. The non-transitory machine readable medium of claim 1, further comprising instructions executable by a processor to display a status icon.

12. The non-transitory machine readable medium of claim 11, wherein the status icon is indicative of a status of the print material.

13. The non-transitory machine readable medium of claim 12, wherein the status icon is displayed having a color corresponding to the status of the print material.

14. A method comprising:

identifying an amount of remaining supply of a print material;

displaying one of a plurality of segments corresponding to the amount of remaining supply of the print material;

identifying one of a plurality of threshold ranges corresponding to the amount of remaining supply of the print material; and updating a visual indicator corresponding to the one of the plurality of threshold ranges, wherein the visual indicator is configured to illuminate, in one of a plurality of colors, an icon associated with the print material, wherein a first threshold range of the plurality of threshold ranges corresponds to an amount of print material to be provided by a replenishment device.

15. The method of claim 14, wherein updating the visual indicator comprises turning off the illumination of the visual indicator for the first threshold range of the plurality of threshold ranges.

16. The method of claim 14, wherein updating the visual indicator comprises illuminating at least one of a plurality of the icon associated with the print material.

17. The method of claim 14, wherein the amount of remaining supply of the print material corresponds to a number of printable pages.

18. A system, comprising:

a supply engine to:

identify an amount of remaining supply of a printing material according to a number of remaining printable pages; and a display engine to:

display one of a plurality of segments corresponding to the amount of remaining supply of the print material, identify one of a plurality of threshold ranges corresponding to the amount of remaining supply of the print material, and update a visual indicator corresponding to the one of the plurality of threshold ranges, wherein the visual indicator is configured to illuminate, in one of a plurality of colors, a plurality of icons associated with the print material, wherein a first threshold range of the plurality of threshold ranges corresponds to an amount of print material to be provided by a replenishment device.

* * * * *